US006502262B1

(12) United States Patent
Piscopo

(10) Patent No.: US 6,502,262 B1
(45) Date of Patent: Jan. 7, 2003

(54) BREASTFEEDING POSITIONING METHOD AND DEVICE

(76) Inventor: Donna Piscopo, 458 Potomac La., Elk Grove Village, IL (US) 60007

( * ) Notice: Subject to any disclaimer, the term of this patent is extended or adjusted under 35 U.S.C. 154(b) by 51 days.

(21) Appl. No.: 09/624,676

(22) Filed: Jul. 24, 2000

(51) Int. Cl.[7] ..... A47G 9/00
(52) U.S. Cl. ..... 5/652; 5/655.9; 5/953
(58) Field of Search ..... 5/652, 655, 655.9, 5/740, 922, 925, 953, 490, 636; 128/845

(56) References Cited

U.S. PATENT DOCUMENTS

| | | | | | |
|---|---|---|---|---|---|
| 2,404,505 | A | | 7/1946 | Knecht | 297/467 |
| 3,101,217 | A | * | 8/1963 | Requa | 5/655.9 X |
| 3,284,817 | A | | 11/1966 | Landwirth | 5/647 |
| 3,333,286 | A | * | 8/1967 | Biolik | 5/632 |
| 4,397,052 | A | | 8/1983 | Lund, III | 5/631 |
| D271,647 | S | * | 12/1983 | McLeod | D6/596 |
| 4,441,221 | A | | 4/1984 | Enste et al. | 5/657 |
| 4,566,449 | A | | 1/1986 | Smith | 5/603 |
| 4,712,833 | A | * | 12/1987 | Swanson | 5/648 X |
| 4,780,921 | A | * | 11/1988 | Lahn et al. | 5/652 X |
| 5,002,046 | A | * | 3/1991 | Scott | 602/36 |
| 5,029,351 | A | | 7/1991 | Weber | 5/655 |
| 5,133,098 | A | | 7/1992 | Weber | 5/655 |
| 5,163,195 | A | * | 11/1992 | Hill | 5/922 X |
| 5,173,979 | A | * | 12/1992 | Nennhaus | 5/490 X |
| 5,331,699 | A | * | 7/1994 | Patton et al. | 5/655 |
| 5,430,902 | A | * | 7/1995 | Lewis | 5/490 |
| 5,450,640 | A | * | 9/1995 | Patton et al. | 5/655 |
| 5,519,906 | A | | 5/1996 | Fanto-Chan | 5/631 |
| 5,522,104 | A | | 6/1996 | Little | 5/632 |
| D376,945 | S | | 12/1996 | Bonaddio et al. | D6/596 |
| 5,581,833 | A | | 12/1996 | Zenoff | 5/655 |
| D384,850 | S | | 10/1997 | Fanuzzi | D6/601 |
| 2001/0044968 | A1 | * | 11/2001 | Schmitter et al. | 5/652 |

OTHER PUBLICATIONS

Gershman, Maurice, M.D. Journal of AMA, vol. 168, No. 7. "Self–Adhering Nylon Tapes", Oct. 18, 1958.*

* cited by examiner

*Primary Examiner*—Robert G. Santos
(74) *Attorney, Agent, or Firm*—Quarles & Brady LLC; Gregory M. Smith

(57) ABSTRACT

A method of supporting a breast in the correct position for breastfeeding by utilizing a support member that is placed against a mother's body and directly under her breast to create support for the breast and correctly position the breast for breastfeeding. A cover surrounds and conforms to the shape of the support member and may be removed for cleaning.

14 Claims, 1 Drawing Sheet

BREASTFEEDING POSITIONING METHOD AND DEVICE

BACKGROUND OF THE INVENTION

The invention is a method of supporting a breast in the correct position during breastfeeding by utilizing a device which supports a nursing mother's breast during breastfeeding. This invention automatically places a nursing mother's breast in the correct position for feeding to ensure the flow of milk, allows the baby to latch on to the breast more easily, assists the mother and the baby to control the breast during breastfeeding, leaves the nursing mother a free hand and enables her to move around while breastfeeding.

When a mother is nursing a baby, she needs to support her breast. The support of the breast generally serves several functions. First, it puts the breast in the optimal position for feeding. This position ensures the flow of milk and helps to avoid sore nipples. Second, it allows the baby to easily "latch on" to the breast. Third, especially for mothers with larger breasts, it assists the mother and baby in controlling the breast while feeding.

Currently, the recommended method for positioning the breast during breastfeeding is commonly called the "C Hold." While one hand is used to hold the baby, the other is used to support the breast in the correct position. The thumb is placed on top of the breast and the fingers are placed below the breast to lift and support it.

The problem with the C Hold is that it is very awkward and difficult for a new mother who is nursing for the first time. In addition, holding the baby and performing the C Hold occupies both of the mother's hands and restricts the mother's movement. Nursing is a learned activity and is usually difficult when attempted for the first time. Learning how to nurse and having both hands in use while learning makes it all the more difficult. In addition, even for experienced mothers, using the C Hold means that the mother cannot do anything while feeding. This is especially inconvenient for mothers who have additional young children who need also need attention.

BRIEF SUMMARY OF THE INVENTION

In one embodiment of the invention, the method of supporting a breast in the correct position during breastfeeding comprises the steps of utilizing a support member that has a generally trapezoidal cross sectional shape. The support member forms a back surface which is placed against a nursing mother's body, a top surface which engages a nursing mother's breast, a bottom surface that is opposite the top surface, a front surface that is opposite the back surface and engages the portion of the breast not supported by the top surface, and first and a second side surfaces which are opposite each other and interconnect the other surfaces.

The current invention avoids the problems that are inherent in the current methods for positioning a mother's breast during nursing. The current invention, unlike current methods, automatically places the breast in the optimal position to ensure the flow of milk, allows the baby to easily latch on to the breast, assists the mother and baby in controlling the breast while feeding, leaves the mother a free hand and enables her to move around while breastfeeding.

It is an object of the current invention to provide a method of supporting a breast in the correct position during breastfeeding that will automatically place a nursing mother's breast in the correct position for nursing therefore ensuring the flow of milk and helping to avoid sore nipples.

It is a further object of the current invention to provide a method of supporting a breast in the correct position during breastfeeding that allows the baby to easily "latch on" to the breast.

It is a further object of the current invention to provide a method of supporting a breast in the correct position during breastfeeding that assists the mother and the baby in controlling the breast while breastfeeding.

It is a further object of the current invention to provide a method of supporting a breast in the correct position during breastfeeding that leaves the mother a free hand and enables her to move around while breastfeeding.

DETAILED DESCRIPTION OF THE PREFERRED EMBODIMENT

Figure 1:
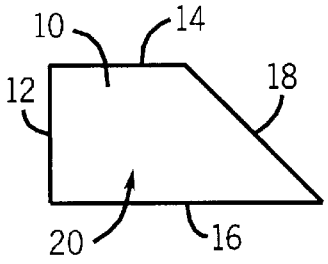
FIG. 1 is a side elevation view of a preferred embodiment of the breastfeeding positioning device utilized in the method of the current invention.
Figure 2:
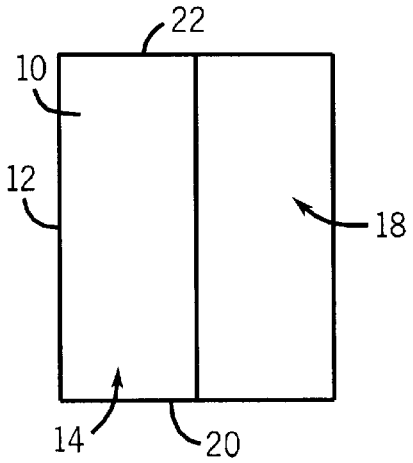
FIG. 2 is a top view of the breastfeeding positioning device.
Figure 3:
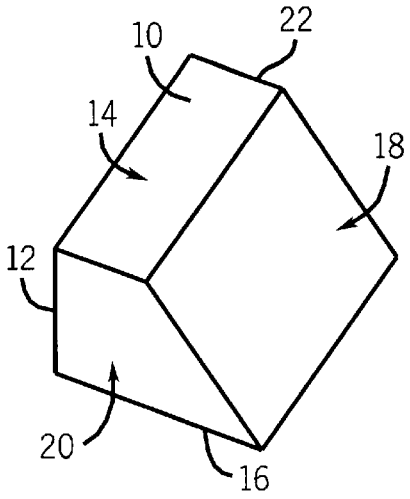
FIG. 3 is a perspective view of the breastfeeding positioning device.

The preferred embodiment of the breastfeeding positioning device utilized in the method of the current invention shown in FIGS. 1–3 provides a device which includes a support member 10 which has a generally trapezoidal cross section and includes various surfaces. The support member 10 acts as a support by creating a ledge that the breast lies on and places the breast in the proper position. The support member 10 is placed directly underneath a nursing mother's breast and against her body and provides the proper support for the breast while breastfeeding.

The support member 10 includes a back surface 12 that is placed against the mother's body just under her breast. The back surface 12 is flat so that it will comfortably fit against the mother's body. In alternate embodiments, the back surface 12 could also be slightly concave. In addition, the back surface 12 must be wide enough to provide support for the entire breast and high enough that it will be able to hold the support member 10 in place when the weight of the breast is applied to the support member 10. The top surface 14 is placed directly under the mother's breast. The top surface 14 is used to support the breast and place the breast in the correct position to ensure the flow of the milk. Again, the top surface 14 must be wide enough to provide support for the entire breast and long enough to that approximately ¾ of the breast is supported by the top surface 14. In order to ensure the proper position of the breast, the top surface 14 should be approximately perpendicular to the back surface 12. If the top surface 14 were to vary too far from perpendicular to the back surface 12, the breast would not be placed in the correct position. Opposite the top surface 14 is a bottom surface 16. The bottom surface 16 is also approximately perpendicular to the back surface 12. The angle that the bottom surface 16 forms with the back surface 12 is not critical as long as the support member 10 still retains the general shape and size that will support the breast in the correct position. Opposite the back surface 12 is the front surface 18. The front surface 18 runs from the top surface 14 to the bottom surface 16 at a down angle from the top surface 14. The front surface 18 is used to comfortably support the front portion of the breast that is not positioned by the top surface 14. The angle formed between the top surface 14 and the front surface 18 is obtuse and the angle formed between the bottom surface 16 and the front surface 18 is acute forming the general trapezoidal shape of the support member 10. A first side surface 20 and a second side surface 22 are opposite each other and interconnect the back surface 12, the top surface 14, the bottom surface 16 and the front surface 18 completing the support member 10. The first side surface 20 and the second side surface 22 are parallel to each other and are perpendicular to the top surface 14, the bottom surface 16 and the front surface 18.

The support member 10 is made from a solid piece of premium density foam having the shape and surfaces described above. In alternate embodiments of the invention, the support member 10 may be constructed from multiple pieces of material that are interconnected to form the shape and surfaces described above or can be formed by a thin material so as to be inflatable. The manner in which the support member 10 is constructed is not critical as long as the support member 10 has the general shape and surfaces described above. In addition, alternate materials may be used to construct the support member 10 as long as the material is strong enough so that the support member 10 can support a nursing mother's breast, soft enough that the support member 10 is still comfortable for the mother, and has a non-slip surface so that the support member 10 stays in place while in use. In addition, since in all likelihood the support member 10 will get wet and dirty during use, the material used to construct the support member 10 should also be washable.

Because the size of nursing mothers' breasts vary, one size support member 10 will not comfortably fit and properly support the breasts of all nursing mothers. The support member 10 is therefore sized according to the breast cup size of the nursing mother. For example, a support member 10 used for a D breast cup size will be wider than a support member 10 used for an A breast cup size to provide complete support for the larger breast. The support member 10, or more specifically the back surface 12, would also be taller to provide greater leverage and support for the larger breast and the top surface 14 and front surface 18 would be longer to fully and comfortably support the breast.

Figure 4:
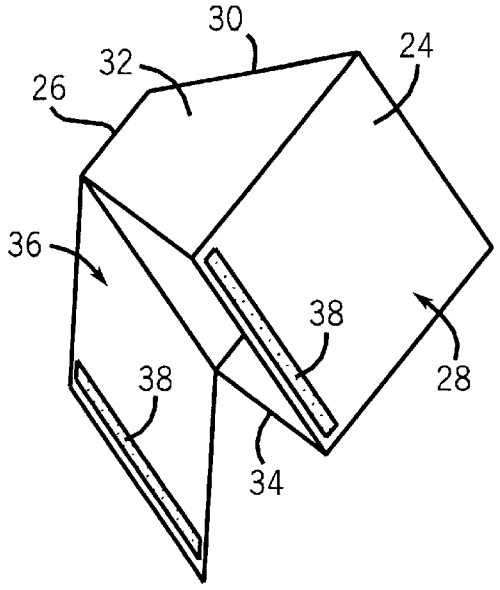
FIG. 4 is a perspective view a cover for the breastfeeding positioning device.

The device may also include a cover 24 as shown in FIG. 4. The cover 24 protects the support member 10 from damage and helps keep the support member 10 clean and dry. In addition, if the entire device were to get wet or dirty, the cover 24 may be removed and washed instead of washing the entire device. Washing only the cover 24 saves wear and tear on the support member 10 that may occur from frequent washings. The cover 24 is constructed with various flaps to completely surround and conform to the shape of the support member 10.

The top flap 26, bottom flap 28, front flap 30, first side flap 32 and second side flap 34 each have a size and shape to conform to the top surface 14, bottom surface 16, front surface 18, first side surface 20 and second side surface 22 respectively and are constructed so that the cover 24 conforms to the shape of and snuggly surrounds the support member 10 on all sides but the back. This leaves an opening in the cover 24 which shows the back surface 12 of the support member 10.

The back flap 36 of the cover 24 is connected only to the top flap 26 so that the back flap 36 can be move to an open and closed position so that the support member 10 can be inserted and removed from the cover 24. The back flap 36 and the bottom flap 28 each contain a strip of Velcro® 38 to keep the back flap 36 in the closed position when the support member 10 is inserted into the cover 24. In alternate embodiments of the invention, the back flap 36 can be kept in the closed position with pins, tape, glue, buttons, or zippers.

The cover 24 is made of cotton. In alternate embodiments of the invention, the cover 24 can be made of any material that is strong enough to resist the wear and tear of use and the constant insertion and removal of the support member, is soft enough that the cover 24 is comfortable for the mother, is non-slip so that the device stays in place while in use, and is washable.

The foregoing description of a preferred embodiment of the invention has been presented for purposes of illustration and description, and is not intended to be exhaustive or to limit the invention to the precise form disclosed. The description was selected to best explain the principles of the invention and their practical application to enable other skills in the art to best utilize the invention in various embodiments and various modifications as are suited to the particular use contemplated. It is intended that the scope of the invention not be limited by the specification, but be defined by the claims set forth below.

I claim:

1. A method of supporting a breast in the correct position during breastfeeding, comprising the steps of:

a. utilizing a support member having a generally trapezoidal cross sectional shape;

b. placing a back surface of the support member such that the back surface engages a nursing mother's body;

c. placing a top surface of the support member such that the top surface engages underneath a nursing mother's breast;

d. placing a front surface of the support member such that the front surface engages underneath the portion of the nursing mother's breast not engaged by the top surface; wherein e. a bottom surface of the support member is opposite the top surface;

f. the front surface of the support member is opposite the back surface and connects the top surface and the bottom surface;

g. a first side surface of the support member interconnects the back surface, the top surface, the bottom surface, and the front surface; and h. a second side surface of the support member, opposite the first side surface, interconnects the back surface, the top surface, the bottom surface, and the front surface.

2. A method of supporting a breast in the correct position during breastfeeding, as recited in claim 1, wherein:

a. the top surface is perpendicular to the back surface;

b. the bottom surface is perpendicular to the back surface and parallel to the top surface;

c. the front surface is at an obtuse angle to the top surface;

d. the front surface is at an acute angle to the bottom surface;

e. the first side surface is perpendicular to the back surface, the top surface, the bottom surface, and the front surface; and f. the second side surface is perpendicular to the back surface, the top surface, the bottom surface, and the front surface, and parallel to the first side surface.

3. A method of supporting a breast in the correct position during breastfeeding, as recited in claim 1, wherein the top surface engages 75% of the nursing mother's breast.

4. A method of supporting a breast in the correct position during breastfeeding, as recited in claim 1, wherein the support member is made from a solid piece of premium density foam.

5. A method of supporting a breast in the correct position during breastfeeding, as recited in claim 1, wherein the support member is made from a solid piece of material which is strong enough to support the nursing mother's breast, is soft enough to be comfortable, has a non-slip surface, and is washable.

6. A method of supporting a breast in the correct position during breastfeeding, as recited in claim 1, wherein the support member is sized according to a nursing mother's breast cup size.

7. A method of supporting a breast in the correct position during breastfeeding, as recited in claim 1, wherein the support member further comprises a cover which encloses and conforms to the shape of the support member and includes a top flap, a bottom flap, a front flap, a back flap, a first side flap and a second side flap.

8. A method of supporting a breast in the correct position during breastfeeding, as recited in claim 7, wherein the cover is made from cotton.

9. A method of supporting a breast in the correct position during breastfeeding, as recited in claim 7, wherein the cover is made from a material which is strong enough to resist wear and tear, is soft enough to be comfortable, has a non-slip surface, and is washable.

10. A method of supporting a breast in the correct position during breastfeeding, as recited in claim 7, wherein the back flap is movable into an open position and a closed position so that the support member can be inserted and removed from the cover.

11. A method of supporting a breast in the correct position during breastfeeding, as recited in claim 10, wherein the cover further comprises a means for holding the back flap in the closed position.

12. A method of supporting a breast in the correct position during breastfeeding, as recited in claim 11, wherein the means for holding the back flap in the closed position is strips of a hook and loop type fastener, such as the one sold under the Trademark of Velcro.

13. A method of supporting a breast in the correct position during breastfeeding, comprising the steps of:

a. utilizing a support member made of a solid piece of premium density foam and having a generally trapezoidal cross sectional shape;

b. placing a back surface of the support member such that the back surface engages a nursing mother's body;

c. placing a top surface of the support member such that the top surface engages underneath a nursing mother's breast;

d. placing a front surface of the support member such that the front surface engages underneath the portion of the nursing mother's breast not engaged by the top surface; wherein e. a bottom surface of the support member is opposite and parallel to the top surface and perpendicular to the back surface;

f. the front surface of the support member is opposite the back surface, at an obtuse angle to the top surface, at an acute angle to the bottom surface, perpendicular to the back surface, and engages 75% of the nursing mother's breast;

g. a first side surface of the support member interconnects and is perpendicular to the back surface, the top surface, the bottom surface, and the front surface; and h. a second side surface of the support member is opposite and parallel to the first side surface and interconnects and is perpendicular to the back surface, the top surface, the bottom surface, and the front surface.

14. A method of supporting a breast in the correct position during breastfeeding, comprising the steps of:

a. utilizing a support member made of a solid piece of premium density foam and having a generally trapezoidal cross sectional shape;

b. placing a back surface of the support member such that the back surface engages a nursing mother's body;

c. placing a top surface of the support member such that the top surface engages underneath a nursing mother's breast;

d. placing a front surface of the support member such that the front surface engages underneath the portion of the nursing mother's breast not engaged by the top surface; wherein e. a bottom surface of the support member is opposite and parallel to the top surface and perpendicular to the back surface;

f. the front surface of the support member is opposite the back surface, at an obtuse angle to the top surface, at an acute angle to the bottom surface, perpendicular to the back surface, and engages 75% of the nursing mother's breast;

g. a first side surface of the support member interconnects and is perpendicular to the back surface, the top surface, the bottom surface, and the front surface; and h. a second side surface of the support member is opposite and parallel to the first side surface and interconnects and is perpendicular to the back surface, the top surface, the bottom surface, and the front surface; and wherein the support member further comprises i. a cover, made of cotton, which encloses and conforms to the shape of the support member and includes a top flap, a bottom flap, a front flap, a back flap, a first side flap and a second side flap; wherein j. the back flap is movable into an open position and a closed position so that the support member can be inserted and removed from the cover; and k. the back flap and the bottom flap include a strip of hook and loop type fastener, such as the one sold under the Trademark of Velcro, to hold the back flap in the closed position.

* * * * *